United States Patent [19]

Day

[11] 4,434,454

[45] Feb. 28, 1984

[54] ACTIVE LIGHTING SYSTEM INCLUDING LIGHT CONTROL KEYBOARD

[76] Inventor: J. Michael Day, 18515 Allendale, Saratoga, Calif. 95070

[21] Appl. No.: 231,960

[22] Filed: Feb. 6, 1981

[51] Int. Cl.[3] ..... F21V 19/00

[52] U.S. Cl. ..... 362/238; 362/2; 362/293; 362/295

[58] Field of Search ..... 362/86, 238, 240, 295, 362/293, 2

[56] References Cited

U.S. PATENT DOCUMENTS

| | | | |
|---|---|---|---|
| 1,844,680 | 2/1932 | Rau | 362/86 X |
| 3,077,138 | 2/1963 | Vaughn, Jr. et al. | 362/86 X |
| 3,184,586 | 5/1965 | Hammes et al. | 362/86 X |
| 3,194,952 | 7/1965 | Wells | 362/86 X |
| 3,218,446 | 11/1965 | Langer | 362/86 X |
| 3,346,732 | 10/1967 | Crusius | 362/86 X |
| 4,161,021 | 7/1979 | George, Jr. | 362/240 X |
| 4,167,783 | 9/1979 | Mitchell | 362/295 X |
| 4,196,460 | 4/1980 | Schreckendgust | 362/295 X |
| 4,220,981 | 9/1980 | Koether | 362/238 X |
| 4,228,487 | 10/1980 | Hesse et al. | 362/240 |

*Primary Examiner*—Peter A. Nelson

*Attorney, Agent, or Firm*—Claude A. S. Hamrick

[57] ABSTRACT

An active lighting system including one or more light stands each supporting a plurality of individually adjustable colored light sources, and a keyboard unit having a plurality of switches and light intensity controlling elements which are touch operated so as to enable the intensity of the various lights in the system to be selectively varied to create a rhythm-to-color display.

6 Claims, 4 Drawing Figures

ACTIVE LIGHTING SYSTEM INCLUDING LIGHT CONTROL KEYBOARD

BACKGROUND OF THE INVENTION

1. Field of the Invention

The present invention relates generally to entertainment lighting apparatus and more particularly to a novel modular lighting system including a keyboard control which enables the intensities of colored lights in the system to be selectively varied.

2. Description of the Prior Art

Heretofore, lighting systems of the type used by rock bands and other musical entertainment groups have involved complex lighting systems which are difficult to transport and time consuming to install. Although most said systems enabled the various lights or combination of lights in the system to be turned on and off, at will, or to simply be dimmed, active intensity modulation was not practical except by some repetitious mechanical means or in some cases by an electronically controllable means which operated in response to the amplitudes of certain sound frequencies generated by one or more electronic instruments. No means has heretofore been provided which allowed various colored lights to be "played" by a skilled technician so as to correspond to and complement the music.

SUMMARY OF THE PRESENT INVENTION

It is therefore a primary objective of the present invention to provide a stage lighting system which enables an entertainer to in effect "play" the various lights in the system in such a way as to reflect the idividuality and creativity of the operator or technician.

Another object of the present invention is to provide a system of the type described which is of modular construction so that it can be easily modified to fit a particular stage setting yet is conveniently transportable and installable.

Briefly, a preferred embodiment of the present invention includes one or more light stands each supporting a plurality of individually adjustable colored light sources, and a keyboard unit having a plurality of switches and light intensity controlling elements which are touch operated so as to enable the intensity of the various lights in the system to be selectively varied to create a rhythm-to-color display.

Among the principal advantages of the present invention is that it enables an entertainer or entertainment group to add a visual dimension to its musical performance which, like its music, reflects the individuality and creativity of the performance.

Another advantage of the present invention is that its components are light weight and easy to erect in any of various combinations found suitable to fit a particular application.

These and other objects and advantages of the present invention will no doubt become apparent to those of ordinary skill in the art after having read the following detailed description of a preferred embodiment which is illustrated in the several figures of the drawing.

IN THE DRAWING

DETAILED DESCRIPTION OF A PREFERRED EMBODIMENT

Figure 1:
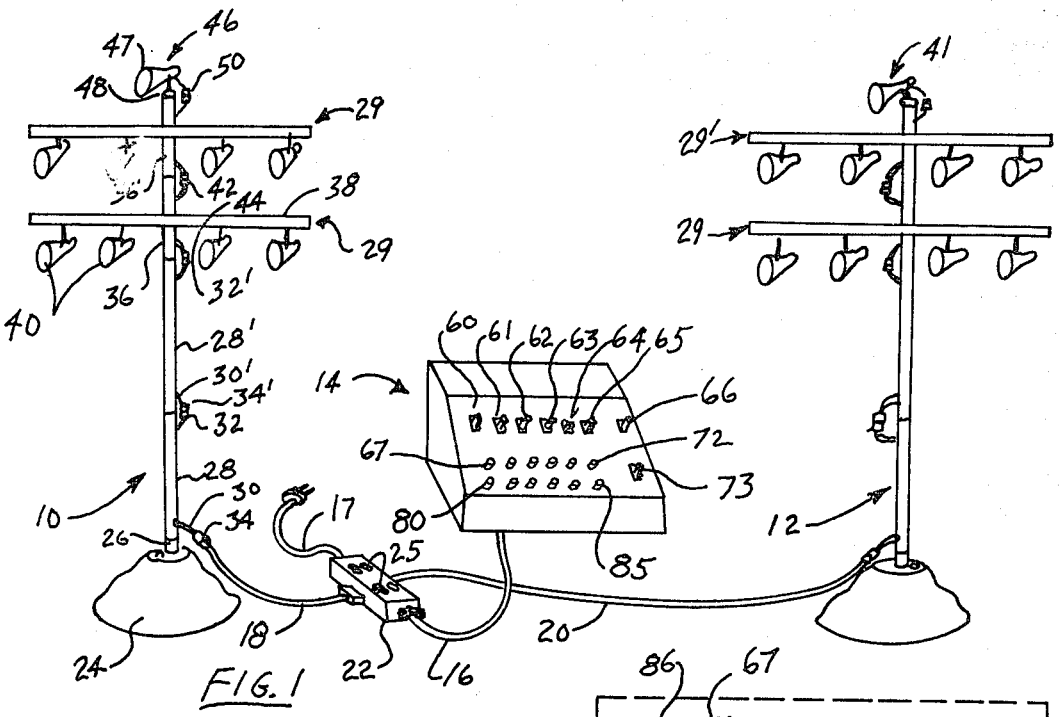
FIG. 1 is a perspective view illustrating an interactive lighting system in accordance with the present invention.
Figure 2:
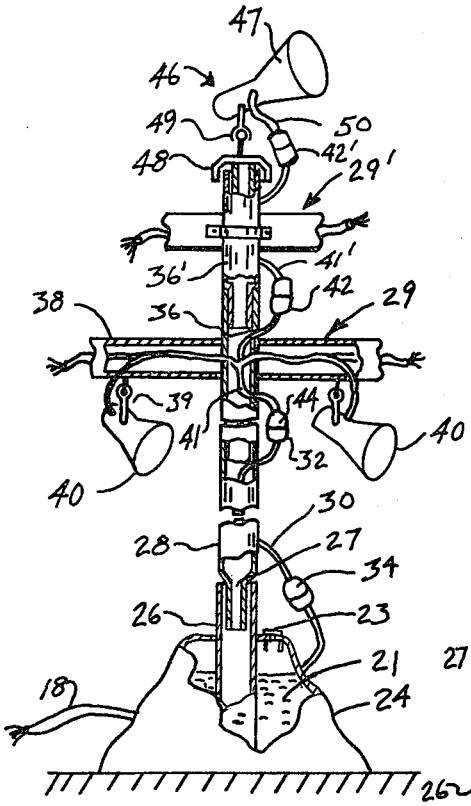
FIG. 2 is a partially broken elevational view showing various details of a light stand of the type illustrated in FIG. 1.

Referring now to FIGS. 1 and 2 of the drawing, an interactive lighting system in accordance with the present invention is shown including a pair of light stands 10 and 12, an operator keyboard 14, interconnecting electrical cables 16, 18 and 20 and a junction box and receptacle unit 22 into which the cables are plug connected.

Each of the light stands shown at 10 and 12 includes a base unit 24 which, for portable convenience, may be constructed of light weight aluminum or other suitable material and form a container into which sand or water 21 can be deposited through an opening 23 (see FIG. 2) to add stabilizing weight to the base. Extending upwardly from the base 24 is a cylindrical stub 26 forming a female socket for receiving one end of a first tubular pole-type riser segment 28.

Riser segment 28 has an outer diameter which is the same as that of stub 26 but has its lower end 27 reduced in cross section so as to be telescopically received within stub 26. Threaded into segment 28 through an opening proximate the upper end thereof and out of an opening proximate the lower end thereof is a length of multi-stran electrical cord or cable 30 having plug connectors 32 and 34 at each end.

Figure 3:
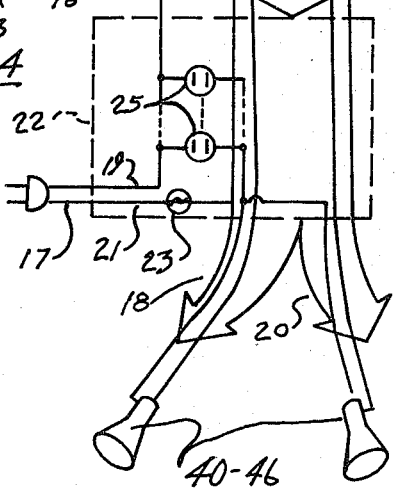
FIG. 3 is a partially broke view illustrating an alternative mechanical and electrical coupling in accordance with the present invention.
Figure 3:
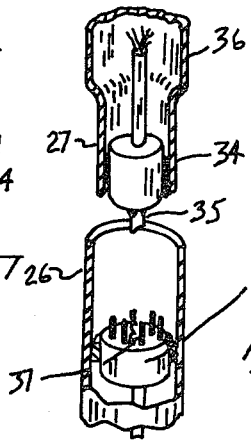

In an alternative configuration shown in FIG. 3, the connectors 34 may be secured to the tube portions 27 and be provided with an alignment key 35 which mates with an alignment socket 37 in the plug 32 which is fixedly secured within the upper end of stubs 26, riser segments 36, etc. In this embodiment, mating engagement of the tubular segments also effects electrical interconnection of the electrical circuits.

As illustrated in FIG. 1, a second riser segment 28' is mated to the first segment 28 by telescopically inserting its reduced diameter lower end into the upper end of segment 28. Note that the second segment 28' also includes a length of cable 30' provided with end connectors 32' and 34'. Connector 34' of the second riser segment is connected to connector 32 of the first riser segment.

Disposed atop the second segment 28' is a first light bar module 29 including a tubular segment 36 which is shorter in length than the segments 28, a horizontal light support beam 28 that is rigidily affixed to segment 36 and four spotlights 40 which are suspended from bar 38 with appropriate swivel connections 39. Segment 36 also has a length of multistran electrical cable 41 extending along its length with male and female connector plugs 42 and 44 affixed to the ends thereof. However, cable 41 is branched proximate the intersection of bar 38 and segment 36 so that four of its conductor pairs extend outwardly to terminate at the respective spotlights 40.

As illustrated, a second light bar module 29', identical to the first, is mounted to the upper end of the first module 29, and is plug connected thereto as shown. Mounted to the top of the tubular segment 36 of the second bar module is a single light module 46 including a spotlight 47, a base 48 which telescopically mates with the upper end of pole 36, and a connector cord and socket 50 for mating with the upper socket 42' of the power cord 41'. The spotlight 46 is also swivel mounted as indicated at 49 so that it can be pointed in any selected direction.

It will thus be appreciated that by simply mating the various component parts together, as illustrated, and plugging the corresponding power cords together a complete lighting unit can be assembled in a manner of minutes.

Keyboard 14 includes six light intensity control rheostats 60 through 65 and a master control rheostat 66. Also provided are at least six touch switches 67–72 and a master switch 73. As will be explained below, a second row of touch switches 80–85 may also be included in keyborad 14.

Figure 4:
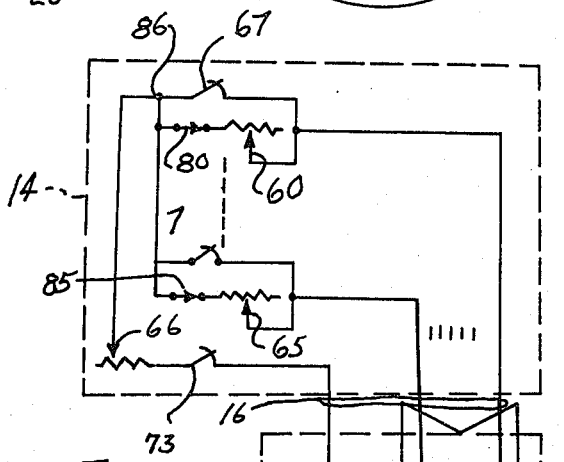
FIG. 4 is a diagram schematically illustrating the electrical control circuitry included within the keyboard unit of the present invention.

In FIG. 4 of the drawing, a schematic circuit in diagrammatically shown illustrating the electrical circuitry of keyboard 14 as well as that of junction box 22. As illustrated, the external power cord 17 extends into box 22 with one conductor 19 thereof being routed via cord 16 to keyboard 14 and the other conductor 21 thereof being routed through a circuit breaker 23 and the cords 18 and 20 to each of the lights 40–46 of the light stands 10 and 12. Also contained within junction box 22 are four power sockets 25 which may be used to power additional equipment.

The line 19 is connected to one side of master switch 73 which is in turn connected through the fader rheostat 66 to a circuit junction 86. Each of the normally open touch switches 67–72 are connected between circuit junction 80 and one or more of the lights 40–46. The light intensity control rheostats 60–65 are respectively connected in parallel with the switches 67–72 and in series with the normally closed touch switches 80–85. It will thus be appreciated that switch 73 serves as a main on/off switch for the system while rheostat 66 serves as a master light level control or fader device. On the other hand, the rheostats 60–65 serve to establish individual color levels for each of the colored lights 40–46 while the switches 67–72 allow the light levels of the several lights 40–46 to be selectively increased from the settings dictated by rheostats 60–65 to the maximum level set by rheostat 66. The second set of normally closed touch switches 80–85 are provided in series with the respective rheostats 60–65 so as to enable the normal light level established by rheostat 60–65 to be selectively reduced to dark by opening the circuits through the rheostats.

In operation, once the system has been assembled with each of the lights 40–46 aimed in particular selections directions, a light operator, who may be either a nonperforming stage technician or one of the stage performers, can create a desired active changing of the various light levels by simply playing the key switches 67–72 and 80–85. If appropriate, he can at the same time adjust the various light levels using the rheostats 60–65 and the main fader switch 66.

Although a preferred embodiment of the present invention has been described above, it will be appreciated that many alterations and modifications of such system will no doubt become apparent to those skilled in the art after having read this disclosure. Accordingly, it is intended that the appended claims be interpreted as covering all such alterations and modifications as fall within the true spirit and scope of the invention.

What is claimed is:

1. An active stage lighting system of the type used to accompany musical performances and the like comprising a plurality of multicolored spotlights;

support means for supporting said spotlights at selected elevations and for allowing said spotlights to be aimed in selected directions, said support means including a base, one or more tubular riser segments, and one or more spotlight carrying modules, all of which may be interconnected to form a single unit, said riser segments and said spotlight carrying modules being provided with lengths of multi wired electrical cable, the respective ends of which include electrical connectors such that when the several cables are connected together, electrical circuits are completed between said keyboard unit and said spotlights, all of the length of each said electrical cable being contained within a corresponding riser segment and the connectors attached to each end thereof being disposed within and affixed to the end portions of the riser segment such that when one riser segment is mated with another, the corresponding connectors are also mated together.

2. An active stage lighting system of the type used to accompany musical performances and the like as recited in claim 1 wherein various ones of said switches are connected in parallel with corresponding ones of said rheostats.

3. An active stage lighting system of the type used to accompany musical performances and the like as recited in claim 2 wherein various other ones of said switches are connected in series with corresponding ones of said rheostats.

4. An active stage lighting system of the type used to accompany musical performances and the like as recited in claim 2 wherein said spotlight carrying modules include a short riser segment, a crossarm affixed to said short riser segment, and swivel means coupling said spotlights to said crossarm.

5. An active stage lighting system of the type used to accompany musical performances and the like as described in claim 1 wherein said coupling means includes a junction box having an input power cord, means for making electrical connection to said spotlights and said light control means.

6. An active stage lighting system of the type used to accompany musical performances and the like as described in claim 1 wherein one of said spotlight carrying modules includes a base for mating with the end of one of said riser segments, and means for coupling the associated spotlight to said base.

* * * * *